US010238909B1

(12) United States Patent
Teeman

(10) Patent No.: US 10,238,909 B1
(45) Date of Patent: Mar. 26, 2019

(54) CHEST MOUNTED, ADJUSTABLE, EXERCISE DEVICE

(71) Applicant: Eric D. Teeman, Lutz, FL (US)

(72) Inventor: Eric D. Teeman, Lutz, FL (US)

( * ) Notice: Subject to any disclaimer, the term of this patent is extended or adjusted under 35 U.S.C. 154(b) by 203 days.

(21) Appl. No.: 15/417,084

(22) Filed: Jan. 26, 2017

(51) Int. Cl.

| | |
|---|---|
| ***A63B 21/00*** | (2006.01) |
| ***A63B 21/04*** | (2006.01) |
| ***A63B 23/02*** | (2006.01) |
| ***A63B 23/12*** | (2006.01) |
| ***A63B 21/055*** | (2006.01) |

(52) U.S. Cl.
CPC .... *A63B 21/4007* (2015.10); *A63B 21/00069* (2013.01); *A63B 21/0428* (2013.01); *A63B 21/0552* (2013.01); *A63B 21/154* (2013.01); *A63B 21/4035* (2015.10); *A63B 21/4045* (2015.10); *A63B 23/0233* (2013.01); *A63B 23/12* (2013.01)

(58) Field of Classification Search
CPC ..... A63B 21/00058; A63B 21/00061; A63B 21/00065; A63B 21/00069; A63B 21/00072; A63B 21/00076; A63B 21/00185; A63B 21/002; A63B 21/0023; A63B 21/008; A63B 21/0083; A63B 21/0085; A63B 21/0087; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/15; A63B 21/151; A63B 21/154; A63B 21/159; A63B 21/4007; A63B 21/4027; A63B 21/4033; A63B 21/4035; A63B 21/4039; A63B 21/4045; A63B 21/4047; A63B 21/4049; A63B 23/0233; A63B 23/025; A63B 23/03516; A63B 23/03525; A63B 23/12; A63B 23/1209; A63B 23/1218; A63B 23/1245; A63B 23/1254; A63B 23/1263; A63B 69/0057; A63B 69/0059; A63B 69/26; A63B 2210/00; A63B 2210/50; A63B 2225/09; A63B 2225/093
See application file for complete search history.

(56) References Cited

U.S. PATENT DOCUMENTS 4,632,393 A * 12/1986 Van Noord ..... A63B 21/00065 482/114
5,501,646 A * 3/1996 Miller ..... A63B 23/025 482/10
5,651,755 A * 7/1997 Chen ..... A63B 21/05 482/126
5,690,597 A * 11/1997 Enfaradi ..... A63B 23/12 482/126
5,749,815 A * 5/1998 Lipps ..... A63B 23/0211 482/121
6,056,676 A * 5/2000 Adams ..... A63B 21/0004 482/112

(Continued)

*Primary Examiner* — Gary D Urbiel Goldner
(74) *Attorney, Agent, or Firm* — Edward P Dutkiewicz

(57) ABSTRACT

A chest mounted, adjustable, exercise device comprising a base plate, a forward extension rail coupled to the base plate, an adjustment slide coupled to the forward extension rail, a track slide coupled to the adjustment slide, and a resistive means being coupled to the forward extension rail.

9 Claims, 7 Drawing Sheets

(56) References Cited

U.S. PATENT DOCUMENTS

| | | | | |
|---|---|---|---|---|
| 6,110,082 | A * | 8/2000 | Tsai | A63B 21/0004 482/121 |
| 6,206,811 | B1 * | 3/2001 | Lat | A63B 21/0004 482/126 |
| 6,296,598 | B1 * | 10/2001 | Boland | A63B 21/0004 482/126 |
| 6,368,257 | B1 * | 4/2002 | Kaplan | A63B 23/03541 482/112 |
| 6,616,582 | B1 * | 9/2003 | Jiang | A63B 19/00 482/140 |
| 8,550,966 | B2 * | 10/2013 | Svatkova Hoeven | A61H 1/005 482/140 |
| 10,071,278 | B2 * | 9/2018 | Svatkova Hoeven | A61H 1/005 |
| 2002/0091048 | A1 * | 7/2002 | Chen | A63B 21/0004 482/126 |
| 2003/0207739 | A1 * | 11/2003 | Whitall | A61H 1/0274 482/92 |
| 2005/0096194 | A1 * | 5/2005 | Bond | A63B 21/055 482/92 |
| 2005/0143232 | A1 * | 6/2005 | Hung | A63B 21/05 482/126 |
| 2009/0062088 | A1 * | 3/2009 | Ismail | A63B 21/0004 482/124 |
| 2013/0059703 | A1 * | 3/2013 | Calantoni | A63B 69/0057 482/126 |
| 2014/0128230 | A1 * | 5/2014 | Burcham | A63B 21/00185 482/123 |
| 2015/0328520 | A1 * | 11/2015 | Barnes | A63B 21/00185 482/56 |
| 2016/0310816 | A1 * | 10/2016 | Horne | A63B 69/3641 |

* cited by examiner

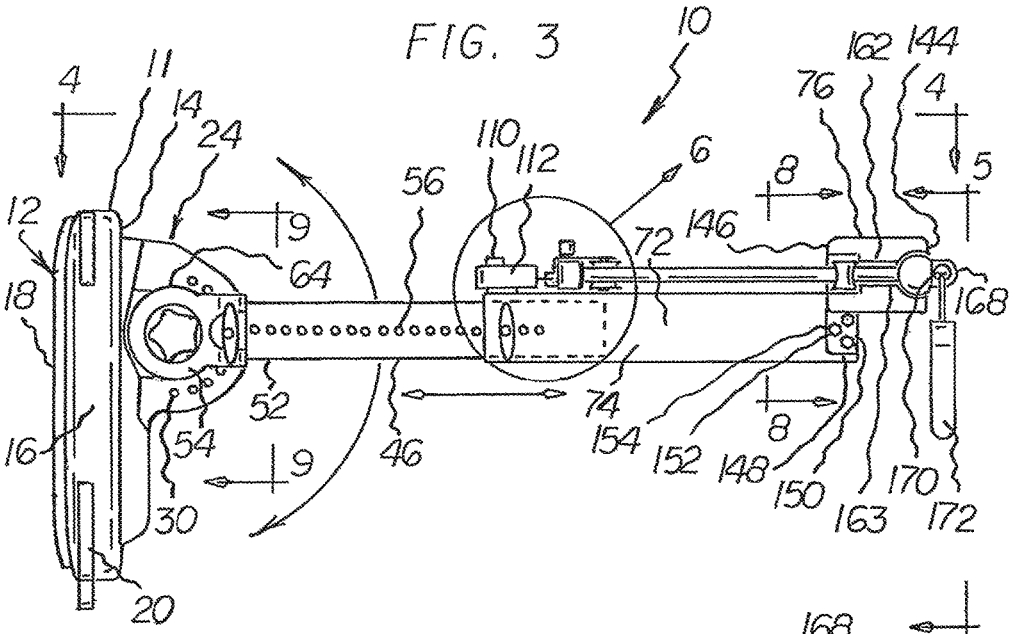
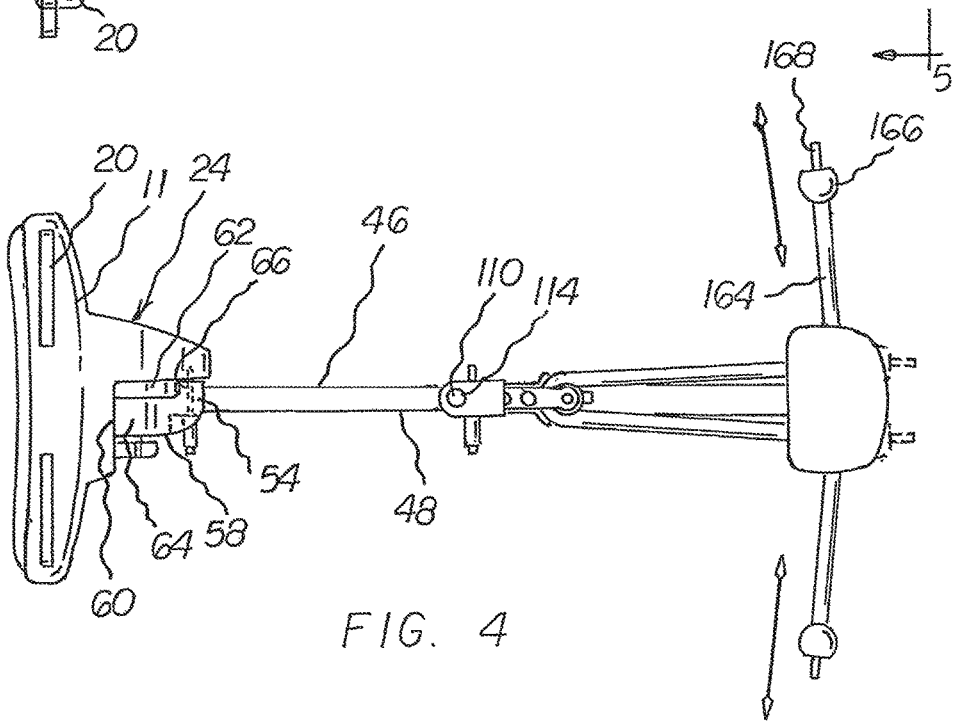
FIG. 4

CHEST MOUNTED, ADJUSTABLE, EXERCISE DEVICE

BACKGROUND OF THE INVENTION

Rule 1.78 (F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The preset invention relates to a chest mounted, adjustable, exercise device and more particularly pertains to an chest mounted, exercise device which a user wears to provide upper body exercise.

DESCRIPTION OF THE PRIOR ART

The use of exercise devices is known in the prior art. More specifically, exercise devices previously devised and utilized for the purpose of providing a user a way to exercise, are known to consist basically of familiar, expected, and obvious structural configurations, notwithstanding the number of designs encompassed by the prior art which has been developed for the fulfillment of objectives and requirements.

While the prior art devices fulfill their respective, particular objectives and requirements, the prior art does not describe a chest mounted, adjustable, exercise device that allows a user to wear the device so as to provide a means of upper body exercise.

In this respect, the chest mounted, adjustable, exercise device according to the present invention substantially departs from the conventional concepts and designs of the prior art, and in doing so provides an apparatus primarily developed for the purpose of allowing a user wear a chest mounted exercise device to provide upper body exercise.

Therefore, it can be appreciated that there exists continuing need for a new and improved exercise device which can be used for providing a user with a chest mounted device to provide a means for upper body exercise. In this regard, the present invention substantially fulfills this need.

SUMMARY OF THE INVENTION

In view or the foregoing disadvantages inherent in the known types of exercise devices now present in the prior art, the present invention provides an improved chest mounted, adjustable exercise device. As such, the general purpose of the present invention, which will be described subsequently in greater detail, is to provide a new and improved exercise device which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain this, the present invention essentially comprises a chest mounted, adjustable, exercise device, comprising several components, in combination.

There is a base plate which is fabricated of rigid material. The base plate has a rearward surface, a forward surface, and a side edge surface there between. The rearward surface and the forward surface each have a generally curved configuration. The rearward surface of the base plate has a generally raised area. The raised area of the rear surface of the base plate is adjacent the side edge. The base plate side edge has a plurality of protrusions comprising a plurality of strap mounts. Each strap mount has a strap slot there through.

The forward surface of the base plate has a generally centrally located extending member mounting portion. The extending member mounting portion of the forward surface of the base plate has a generally semicircular forwardly projecting protrusion, with the forwardly projecting protrusion having an arcuate recess and a generally centrally located pivot pin hole. The arcuate recess has a plurality of position locking pin holes there through. The locking pin holes of the arcuate recess has an associated position locking pin. The centrally located pivot pin hole of the forwardly projecting protrusion of the base plate has an associated threaded pivot pin bolt and pivot pin nut. The forwardly projecting protrusion of the base plate has a right side, a left side, and a side edge there between. The right side of the forwardly projecting protrusion of the base plate forming a contacting surface. The contacting surface has a generally planar surface with the centrally located pivot pin being located there through.

Thee is a forward extension rail. The forward extension rail is fabricated of a rigid material. The forward extension rail has a forward portion, with a forward end, and a rearward portion, with a rearward end. There is a length located between the forward extension rail forward portion and the forward extension rail rearward end. The length of the forward extension rail has a generally rectilinear solid tubular configuration, with a plurality of forward and rearward locking pin holes there through. The length of the forward extension rail has a first external width, and a first external height. The rearward end of the rearward portion of the forward extension rail comprises a generally planar right surface, having a curved terminus, and a left surface, with a curved side surface forming a side edge there between. The left surface of the rearward end of the rearward portion of the forward extension rail has a generally rightward offset. The left surface of the rearward portion of the rearward end of the forward extension rail is generally planar so as to be mated with and received by the forwardly projecting protrusion of the base plate.

The rearward end of the rearward portion of the forward extension rail has a pivot pin hole there through and a locking pin hole there through. The forward end of the forward extension rail has a generally rectilinearly shaped terminus.

There is an adjustment slide. The adjustment slide has a lower slide mount portion and a upper working portion. The lower slide mount portion has a generally rectilinear hollow tubular configuration with an upper surface and generally parallel lower surface. The lower slide mount portion also has a pair of generally parallel side surfaces. The hollow tubular configuration of the adjustment slide forms a passageway there through.

The adjustment slide lower slide mount portion has a rearward end and a forward end, with a length there between. The rearward end of the adjustment slide lower slide mount portion has at least one forward and rearward locking pin hole there through. The forward end of the adjustment slide lower slide mount portion has at least one working end mounting bolt holes there through.

The lower slide mount portion of the adjustment slide has a second internal width and a second internal height. The second internal width of the lower slide mount portion of the adjustment slide is greater than the first external width of the forward extension rail. The second internal height of the lower slide mount portion of the adjustment slide is greater than the first external height of the forward extension rail, so as to allow the lower slide mount to be slidably mounted onto the forward extension rail.

The lower slide mount portion of the adjustment slide has at least one forward and rearward locking pin hole there through, with the forward and rearward locking pin hole of the lower slide mount of the adjustment slide having an associated forward and rearward locking pin. The lower slide mount portion of the adjustment slide has an upper T shaped track along the upper surface of the lower slide mount portion of the adjustment slide.

There is a track slide position retainer. The track slide position retainer is fabricated of a rigid material. The track slide position retainer has a lower, generally T shaped configuration which is sized to be mated with and located within the T shaped track of the upper surface of the lower slide mount portion of the adjustment slide.

The lower portion of the track slide position retainer has an end flange. The track slide position retainer has an upper portion. The upper portion of the track slide position retainer has a generally planar oval configuration with a retention band recess therein. The upper portion of the track slide position retainer has an uppermost surface. The uppermost surface of the upper portion of the track slide position retainer has a cover threaded bolt hole there in. The upper portion of the track slide position retainer has an associated cover bolt.

There is a track slide position retainer cover. The t rack slide position retainer cover has a generally oval side wall, with an open end and a planar top portion. The planar top portion of the track slide position retainer cover has a cover retaining bolt hole there through, thereby allowing the bolting of the track slide position retainer cover to the track slide position retainer.

There is a track slide which is fabricated of a rigid material. The track slide has a lower, generally T shaped configuration which is sized to be mated with and slidably received within the T shaped track of the upper surface of the lower slide mount portion of the adjustment slide. The track slide has an upper portion. The upper portion of the track slide has a rearwardly located bracket mount, having a slot therein. The upper portion of the track slide has a forwardly mounted holding post. The holding post has a threaded aperture therein, with an associated threaded holding post retaining bolt.

The upper portion of the track slide holding post has an elastic guard. The elastic guard has a generally curved planar configuration. The holding post of the upper portion of the track slide has a forwardly projecting pulley shoe. There is a pulley bolt hole running through the pulley shoe. The upper portion of the track slide has an associated elastic band pulley. The pulley has a pulley bolt hole there through, with an associated pulley bolt. The pulley is held in position with a pulley retention bracket. The pulley retention bracket has a generally Z shaped configuration, with the pulley retention bracket having a rearwardly disposed lip which is sized to engage with and be received by the rearwardly located bracket mount slot of the upper portion of the track slide, the pulley retention bracket having a holding post bolt aperture there through, for fixedly securing the pulley retention bracket to the holding post of the upper portion of the track slide. The pulley retention bracket has a pulley bolt aperture there through, with an associated pulley bolt for fixedly securing the pulley between the pulley retention bracket and the pulley shoe.

The adjustment slide upper working portion has a forward end and a rearward end, with a length there between. The rearward end of the adjustment slide upper working portion has a mounting bracket. The adjustment slide upper working portion mounting bracket has a pair of downwardly disposed tabs, with each tab having a plurality of bolt holes there through. Each of the downwardly disposed tabs has associated adjustment slide upper working portion bolts. The adjustment slide upper working portion bolts fixedly secure the adjustment slide upper working portion to the forward end of the adjustment slide. The adjustment slide upper working portion mounting bracket has a pair of oppositely oriented U shaped pulley receiving brackets. Each of the oppositely oriented U shaped pulley receiving brackets has a forward pulley pin hole there through. The adjustment slide upper working portion mounting bracket has a pair of associated forward pulleys, with associated forward pulley pins. The forward pulley pins hold each of the forward pulleys within each of the U shaped mounting brackets. The adjustment slide upper working portion has a elastic band retainer. The elastic band retainer has a generally H shaped configuration, with a pair of stepped elastic band passageway grooves there in. The step of each elastic passageway groove has a first passageway internal diameter and a second passageway internal diameter. The second passageway internal diameter is greater than the first passageway internal diameter.

There is an exercise elastic. The exercise elastic has a pair of like configured ends. The ends of the exercise elastic each have a stop ball and an attachment tab, with an attachment aperture there through. Each of the stop balls has an external diameter which is smaller than the second internal diameter of the passageway groove and larger than the first internal diameter of the passageway groove, thereby allowing the ball to be nested within the passageway groove of the adjustment slide upper working portion. The attachment aperture allows a user to attach a hand grip to the exercise elastic.

Lastly, there is at least one strap which attaches to the strap holes of the base plate. The strap, or if there are a plurality of straps, the straps, secures the device in position on a user's chest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved chest mounted, adjustable, exercise device which has all of the advantages of the prior art exercise devices and none of the disadvantages.

It is another object of the present invention to provide a new and improved chest mounted, adjustable, exercise device which may be easily and efficiently manufactured and marketed.

It is further object of the present invention to provide a new and improved chest mounted, adjustable, exercise device which is of durable and reliable constructions.

An even further object of the present invention is to provide a new and improved chest mounted, adjustable, exercise device which is susceptible of a low cost of manufacture with regard to both materials and labor, and which accordingly is then susceptible of low prices of sale to the consuming public, thereby making such chest mounted, adjustable, exercise device economically available to the buying public.

Even still another object of the present invention is to provide a chest mounted, adjustable, exercise device for allowing a user to have a means for upper body exercise.

Lastly, it is an object of the present invention to provide a new and improved chest mounted, adjustable, exercise device comprising a base plate, a forward extension rail coupled to the base plate, an adjustment slide coupled to the forward extension rail, a track slide coupled to the adjustment slide, and a resistive means being coupled to the extension rail.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a right side elevational view of the device, showing the device extended, forward.

FIG. 4 is a view taken along line 4-4 of FIG. 3, showing the device extended, forward.

The same reference numerals refer to the same parts throughout the various Figures.

DESCRIPTION OF THE PREFERRED EMBODIMENT

Figure 1:
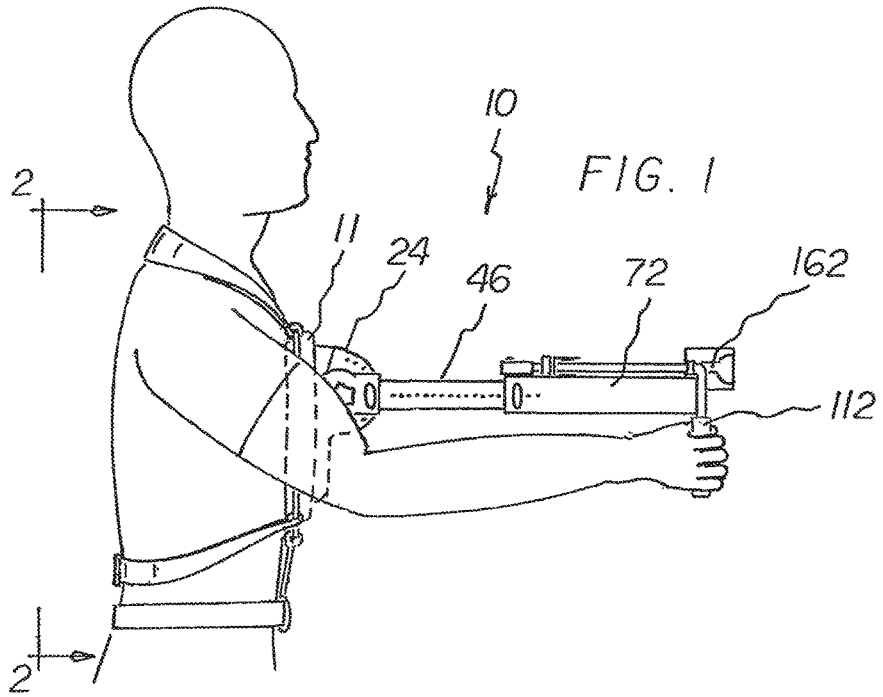
FIG. 1 is a right side elevational view of a user employing the chest mounted, adjustable, exercise device.
Figure 2:
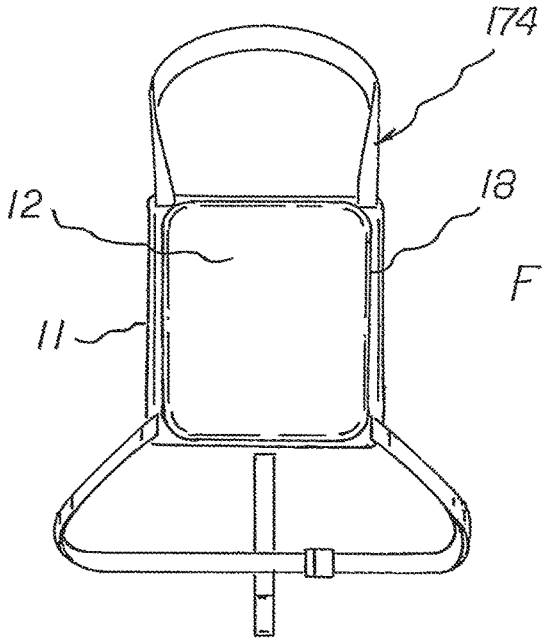
FIG. 2 is a rear view of the device, showing the straps attached to the base plate.
Figure 5:
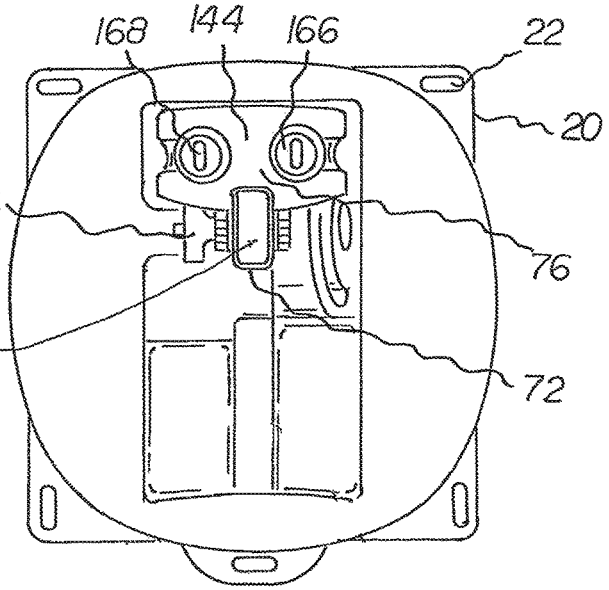
FIG. 5 is a view taken along line 5-5 of FIG 3.
Figure 6:
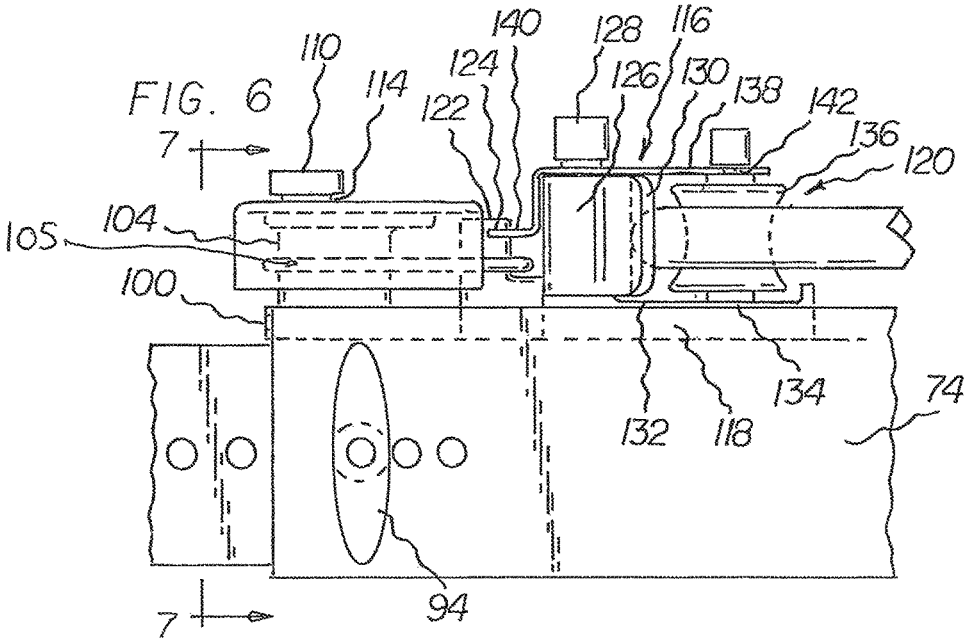
FIG. 6 is a close-up view taken in circle 6 of FIG. 3.
Figure 7:
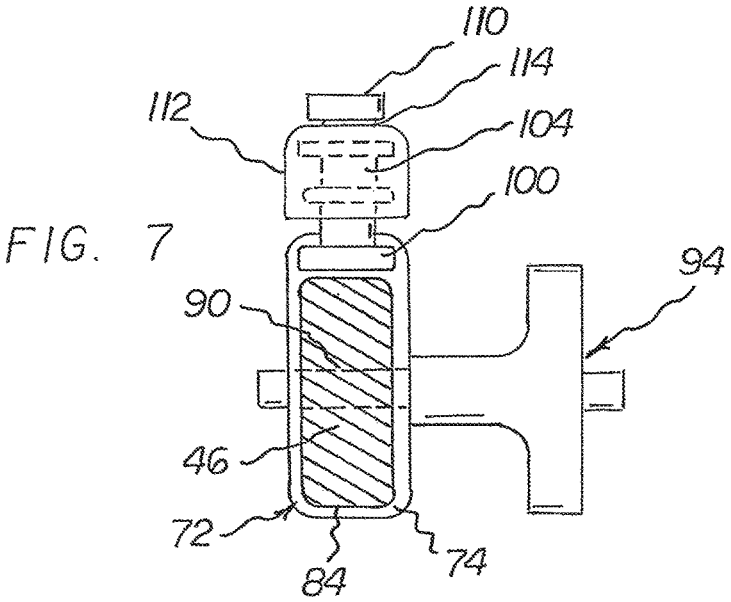
FIG. 7 is a view taken along line 7-7 of FIG. 6.
Figure 8:
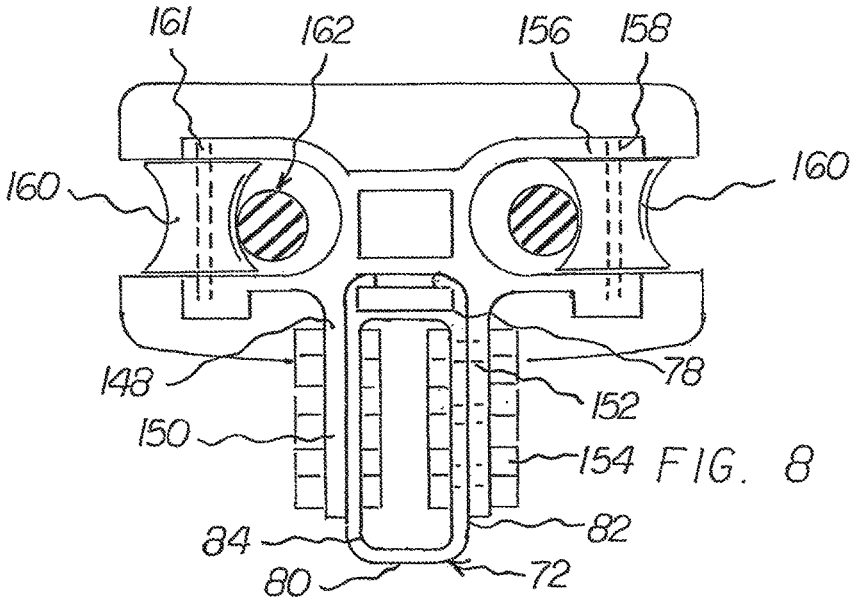
FIG. 8 is a view taken along line 8-8 of FIG. 3.
Figure 9:
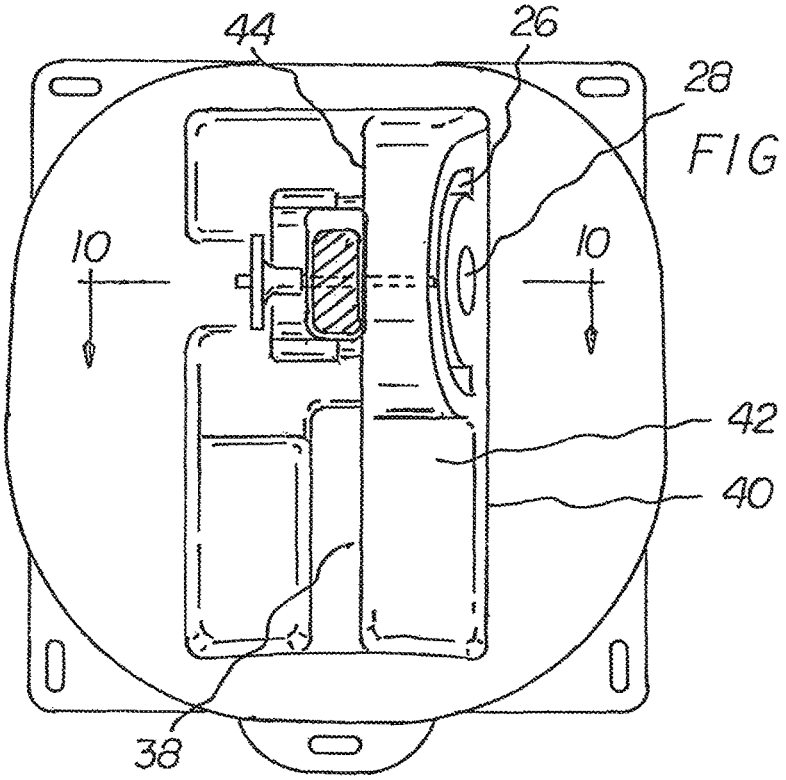
FIG. 9 is a view taken along line 9-9 of FIG. 3.
Figure 10:
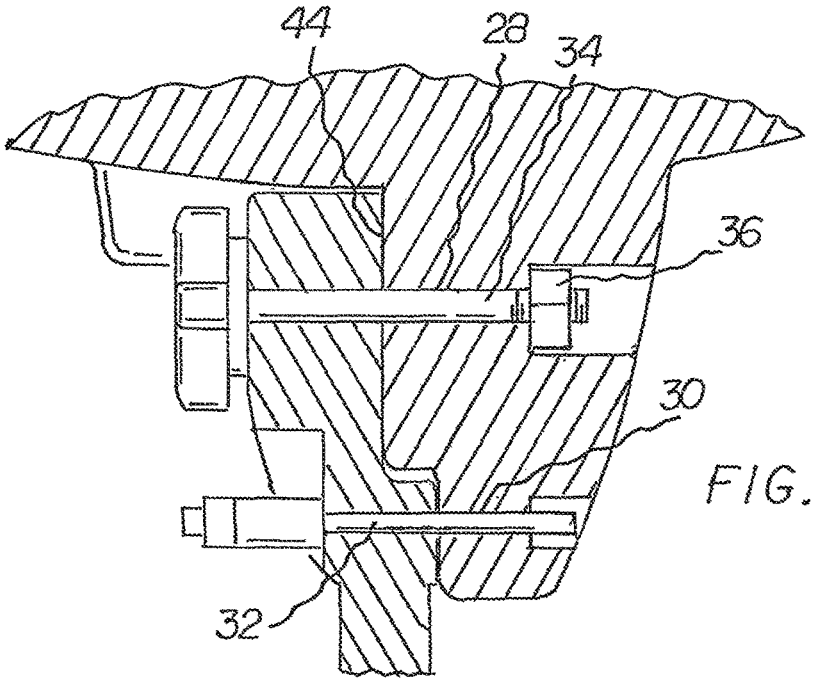
FIG. 10 is a view taken along line 10-10 of FIG. 9.
Figure 11:
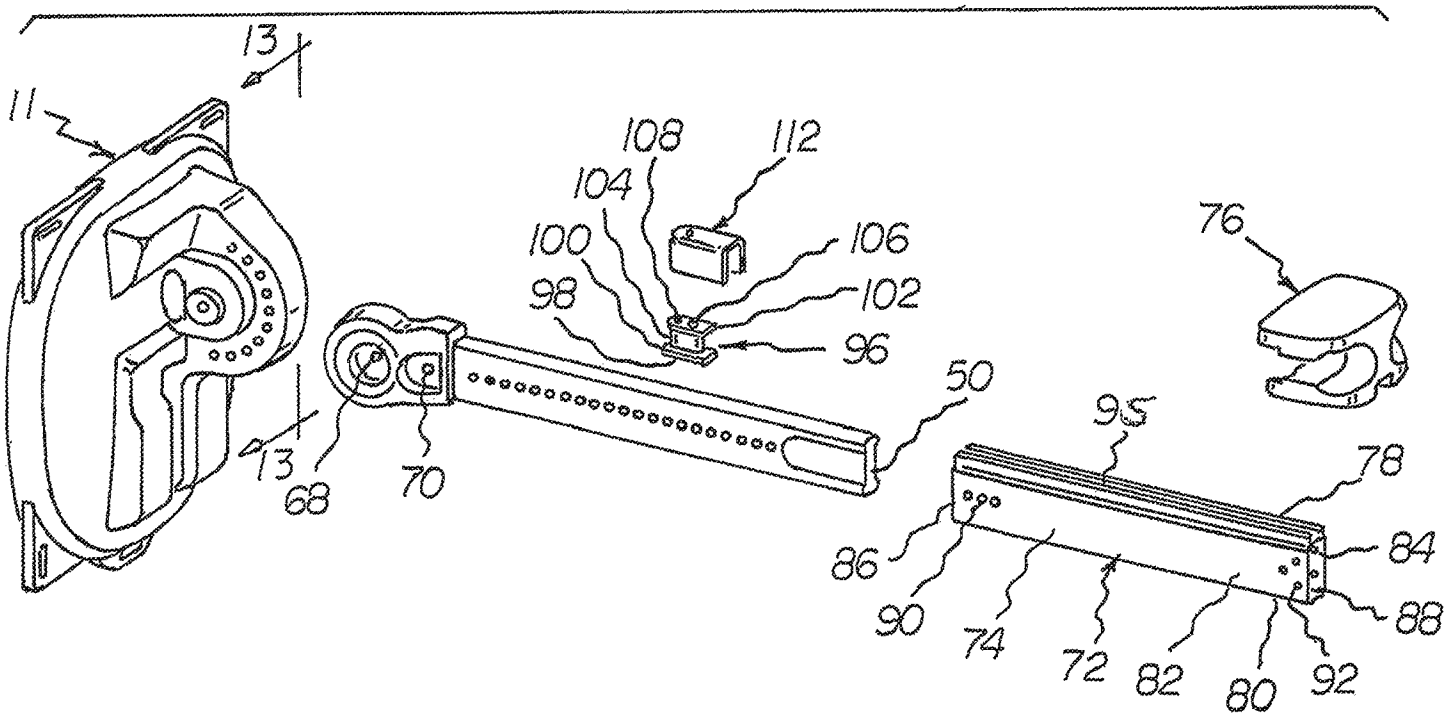
FIG. 11 is an exploded view, showing components of the device.
Figure 12:
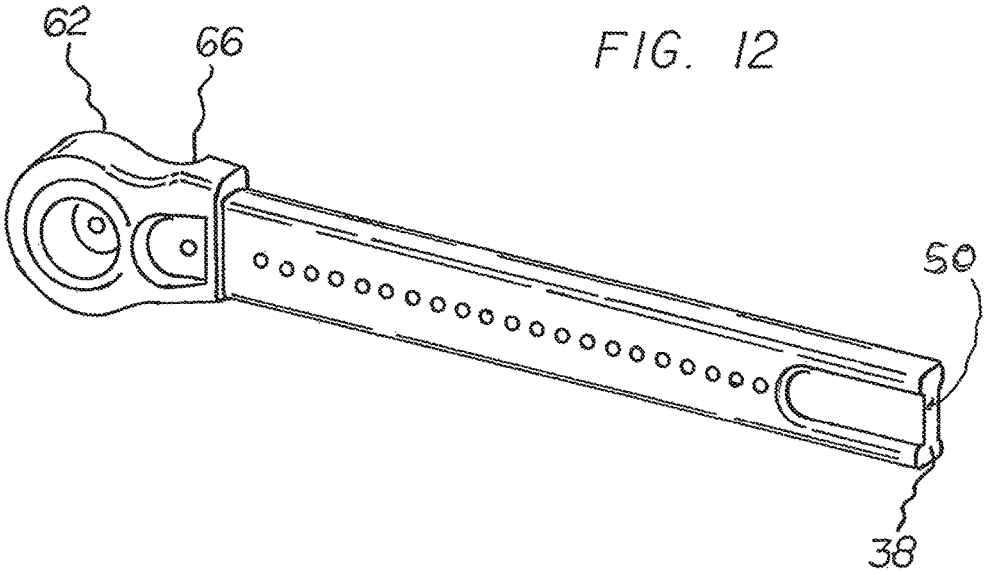
FIG. 12 is a right side perspective view of the forward extension rail.
Figure 13:
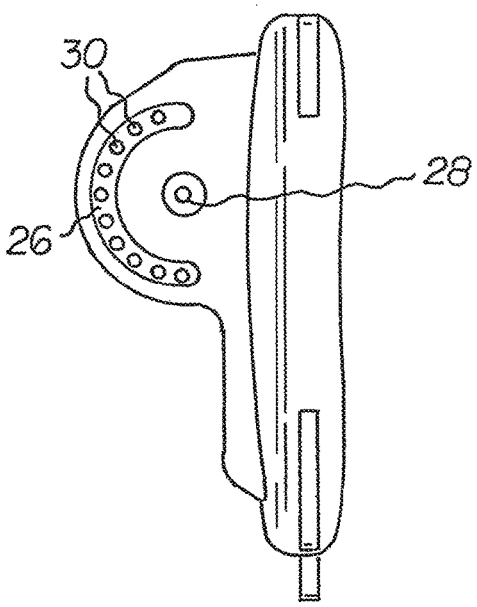
FIG. 13 is a left side elevational view of the base plate.

With reference now to the drawings, and in particular to FIG. 1 thereof, the preferred embodiment of the new and improved chest mounted, adjustable, exercise device embodying the principles and concepts of the present invention and generally designated by the reference numeral 10 will be described.

The present invention, the chest mounted, adjustable, exercise device 10 is comprised of a plurality of components. Such components in their broadest context include a base plate, a forward extension rail, an adjustment slide and an elastic resistive means. Such components are individually configured and correlated with respect to each other so as to attain the desired objective.

A chest mounted, adjustable, exercise device 10, comprising several components, in combination, is herein described.

There is a base plate 11 which is fabricated of rigid material. The base plate has a rearward surface 12, a forward surface 14, and a side edge surface 16 there between. The rearward surface and the forward surface each have a generally curved configuration. The rearward surface of the base plate has a generally raised area 18. In use, the raised area provides a mounting position for a cushioning material, so as to make the contact with a user's chest more comfortable. Cushioning may be held in place by a hook and loop fastening device. The raised area of the rear surface of the base plate is adjacent the side edge. The base plate side edge has a plurality of protrusions 20 comprising a plurality of strap mounts. Each strap mount has a strap slot 22 there through.

The forward surface of the base plate has a generally centrally located extending member mounting portion 24. The extending member mounting portion of the forward surface of the base plate has a generally semicircular forwardly projecting protrusion, with the forwardly projecting protrusion having an arcuate recess 26 and a generally centrally located pivot pin hole 28. The arcuate recess has a plurality of position locking pin holes 30 there through. The locking pin holes of the arcuate recess has an associated position locking pin 32. The centrally located pivot pin hole of the forwardly projecting protrusion of the base plate has an associated threaded pivot pin bolt 34 and pivot pin nut 36. The forwardly projecting protrusion of the base plate has a right side 38, a left side 40, and a side edge 42 there between. The right side of the forwardly projecting protrusion of the base plate forming a contacting surface 44. The contacting surface has a generally planar surface with the centrally located pivot pin being located there through.

Thee is a forward extension rail 46. The forward extension rail is fabricated of a rigid material. The forward extension rail has a forward portion 48, with a forward end 50, and a rearward portion 52, with a rearward end 54. There is a length located between the forward extension rail forward portion and the forward extension rail rearward end. The length of the forward extension rail has a generally rectilinear solid tubular configuration, with a plurality of forward and rearward locking pin holes 56 there through. The length of the forward extension rail has a first external width and a first external height. In other variations, the forward extension rail may be round, triangular, ovoid, or any other shape. The forward extension rail may be in the form of a hollow tube.

The rearward end of the rearward portion of the forward extension rail comprises a generally planar right surface 58, having a curved terminus 60, and a left surface 62, with a curved side surface forming a side edge 64 there between. The left surface of the rearward end of the rearward portion of the forward extension rail has a generally rightward offset 66. The left surface of the rearward portion of the rearward end of the forward extension rail is generally planar so as to be mated with and received by the forwardly projecting protrusion of the base plate.

The rearward end the rearward portion of the forward extension rail has a pivot pin hole 68 there through and a locking pin hole 70 there through. The forward end of the forward extension rail has a generally rectilinearly shaped terminus. The rearward portion of the forward extension rail is pivotably mounted to the extending member mounting portion, thereby allowing the extension rail to be rotated and positioned about the pivot pin bolt at an angle.

In a variation, the forward extension rail may comprise a rectangular configuration with a series of notches or holes, herein collectively referred to as apertures, along the upper surface of the forward extension. Each aperture provide an anchoring point for a subassembly having at least one elastomeric band, at least one pulley, and, at least one hand grip.

There is an adjustment slide 72. The adjustment slide has lower side mount portion 74 and a upper working portion 76. The lower slide mount portion has a generally rectilinear hollow tubular configuration with an upper surface 78 and generally parallel lower surface 80. The lower slide mount portion also has a pair of generally parallel side surfaces 82. The hollow tubular configuration of adjustment slide forms a passageway 84 there through.

The adjustment slide is configured to mate with and slide on the forward extension rail. In the variation where the forward extension rail has a round or ovoid configuration, then the adjustment slide has a round or ovoid passageway there through so as to slide onto and mate with the forward extension rail.

The adjustment slide lower slide mount portion has a rearward end 86 and a forward end 88, with a length there between. The rearward end of the adjustment slide lower slide mount portion has at least one forward and rearward locking pin hole 90 there through. The forward end of the adjustment slide lower slide mount portion has at least one working end mounting bolt holes 92 there through.

The lower slide mount portion of the adjustment slide has a second internal width and a second internal height. The second internal width of the lower slide mount portion of the adjustment slide is greater than the first external width of the forward extension rail. The second internal height of the lower slide mount portion of the adjustment slide is greater than the first external height of the forward extension rail, so as to allow the lower slide mount to be slidably mounted onto the forward extension rail.

The lower slide mount portion forward and rearward locking pin hole having an associated forward and rearward locking pin 94. The lower slide mount portion of the adjustment slide has an upper T shaped track 95 along the upper surface of the lower slide mount portion of the adjustment slide.

There is a track slide position retainer 96. The track slide position retainer is fabricated of a rigid material. The track slide position retainer has a lower, generally T shaped configuration 98 which is sized to be mated with and located within the T shaped track of the upper surface of the lower slide mount portion of the adjustment slide. In the preferred embodiment the track slide position retainer is fixed within the track, so as to provide a point of return for the track slide.

The lower portion of the track slide position retainer has an end flange 100. The track slide position retainer has an upper portion 102. The upper portion of the track slide position retainer has a generally planar oval configuration with a retention band recess 104 therein. There is a retention elastomeric retention band 105 which is located within the retention band recess of the lower portion of the track slide position retainer.

The upper portion of the track slide position retainer has an uppermost surface 106. The uppermost surface of the upper portion of the track slide position retainer has a cover threaded bolt hole 108 there in. The upper portion of the track slide position retainer has an associated cover bolt 110.

There is a track slide position retainer cover 112. The track slide position retainer cover has a generally oval side wall, with an open end and a planar top portion. The planar top portion of the track slide position retainer cover has a cover retaining bolt hole 114 there through, thereby allowing the bolting of the track slide position retainer cover to the track slide position retainer.

There is a track slide 116 which is fabricated of a rigid material. The track slide has a lower, generally T shaped configuration 118 which is sized to be mated with and slidably received within the T shaped track of the upper surface of the lower slide mount portion of the adjustment slide. The track slide has an upper portion 120. The upper portion of the track slide has a rearwardly located bracket mount 122, having a slot 124 therein. The upper portion of the track slide has a forwardly mounted holding post 126. The holding post has a threaded aperture therein, with an associated threaded holding post retaining bolt 128.

The upper portion of the track slide holding post has an elastic guard 130. The elastic guard has a generally curved planar configuration. The holding post of the upper portion of the track slide has a forwardly projecting pulley shoe 132. There is a pulley bolt hole 134 running through the pulley shoe. The upper portion of the track slide has an associated elastic band pulley 136. The pulley has a pulley bolt hole there through, with an associated pulley bolt. The pulley is held in position with a pulley retention bracket 138. The pulley retention bracket has a generally Z shaped configuration, with the pulley retention bracket having a rearwardly disposed lip 140 which is sized to engage with and be received by the rearwardly located bracket mount slot of the upper portion of the track slide, the pulley retention bracket having a holding post bolt aperture 142 there through, for fixedly securing the pulley retention bracket to the holding post of the upper portion of the track slide. The pulley retention bracket has a pulley bolt aperture there through, with an associated pulley bolt for fixedly securing the pulley between the pulley retention bracket and the pulley shoe.

The lower portion of the track slide position retainer is coupled to the track slide by the elastomeric retention band, allowing the track pulley to slide forward as the user pulls the handles. The elastomeric retention band serves to bring the track slide pulley back to an original position as the handles are returned to an original position.

The adjustment slide upper working portion has a forward end 144 and a rearward end 146, with a length there between. The rearward end of the adjustment slide upper working portion has a mounting bracket 148. The adjustment slide upper working portion mounting bracket has a pair of downwardly disposed tabs 150, with each tab having a plurality of bolt holes 152 there through. Each of the downwardly disposed tabs has associated adjustment slide upper working portion bolts 154. The adjustment slide upper working portion bolts fixedly secure the adjustment slide upper working portion to the forward end of the adjustment slide. The adjustment slide upper working portion mounting bracket has a pair of oppositely oriented U shaped pulley receiving brackets 156. Each of the oppositely oriented U shaped pulley receiving brackets has a forward pulley pin hole 158 there through. The adjustment slide upper working portion mounting bracket has a pair of associated forward pulleys 160, with associated forward pulley pins 161. The forward pulley pins hold each of the forward pulleys within each of the U shaped mounting brackets. The adjustment slide upper working portion has a elastic band retainer 162. The elastic band retainer has a generally H shape configuration, with a pair of stepped elastic band passageway grooves 163 there in. The step of each elastic passageway groove has a first passageway internal diameter and a second passageway internal diameter. The second passageway internal diameter is greater than the first passageway internal diameter.

There is resistive means. In the preferred embodiment the resistive means is an exercise elastic 164. The exercise elastic has a pair of like configured ends. The ends of the exercise elastic each have a stop ball 166 and an attachment tab 168, with an attachment aperture 170 there through. Each of the stop balls has an external diameter which is smaller than the second internal diameter of the passageway groove and larger than the first internal diameter of the passageway groove, thereby allowing the ball to be nested within the passageway groove of the adjustment slide upper working portion. The attachment aperture allows a user to attach a hand grip 172 to the exercise elastic.

In another variation, the resistive means may an elastomeric band or a spring or a pair of magnets, or a piston subassembly, which includes hydraulic piston subassemblies and pneumatic piston subassemblies, wherein the magnets work to either attract or repel each other, so as to provide a force, or resistance, which a user must overcome. In this variation the spring, in the form of a coil spring is coupled to a pulley, and the pulley is coupled to the adjustment slide upper working portion. The pulley and spring have an associated pulley pin, holding the pulley in place on the adjustment slide upper working portion. In this variation, the pulley has a rope, or line, wrapped around the pulley, so that pulling in the line causes the spring to be wound tight, thereby providing resistance to the line being pulled. The line has a pair of handles coupled thereto, allowing a user to easily grip and pull the line.

Lastly, there is a strap 174 which attaches to the strap holes of the base plate. The strap secures the device in position on a user's chest. There may be a plurality of straps, working together to hold the exercise device base plate in position on a user's chest.

In use the device provides a user with a easily storable, portable means to exercise the neck, arms, shoulders, and back. The device may be configured in many ways, such as the elastic resistive means may be anchored to areas other than the top of the slide, such as the sides or bottom of the slide. Resistive means, such as a piston arrangement, may be used in place of the elastic means of the preferred embodiment.

The base plate, or chest plate, may contain a compartment, for the storage of elastic bands, grips, or spare parts, such as pulleys or pulley pins. The device may provided with a stand for storage when not in use, or a wall mounting bracket, for fixing the exercise device to a surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A chest mounted, adjustable, exercise device comprising, in combination;

a base plate, the base plate having a rearward surface and a forward surface and a side edge surface there between, the forward surface of the base plate having a generally centrally located extending member mounting portion, the base plate rearward surface and the base plate forward surface each having a generally curved configuration;

a forward extension rail having a forward portion with a forward end, and a rearward portion with a rearward end, with a length there between, the forward extension rail being coupled to the base plate, the forward extension rail being pivotably coupled to the base plate, the length of the forward extension rail having a generally rectilinear solid tubular configuration with a plurality of forward and rearward locking pin holes there through;

an adjustment slide, with the adjustment slide having a lower slide mount portion and an upper working portion, the adjustment slide being slidably coupled to the forward extension rail, the adjustment slide lower slide mount portion having a generally rectilinear hollow tubular configuration with an upper surface and a generally parallel lower surface and a pair of generally parallel side surfaces, the generally rectilinear hollow tubular configuration of the adjustment slide forming a passageway there through, the adjustment slide lower slide mount portion having a rearward end and a forward end, with a length there between, the adjustment slide upper working portion having a mounting bracket with the adjustment slide upper working portion mounting bracket having a pair of oppositely oriented U-shaped pulley receiving brackets, with each oppositely oriented U-shaped pulley receiving bracket having a forward pulley pin hole there through;

a track slide coupled to the adjustment slide with the track slide having an upper portion, the track slide upper portion having a rearwardly located bracket mount having a slot therein, the upper portion of the track slide having a forwardly mounted holding post;

a track slide position retainer having an upper portion and a lower portion, with the lower portion having a generally T-shaped configuration, the track slide position retainer being operatively coupled to the forward extension rail; and a resistive means being coupled to the forward extension rail.

2. The chest mounted, adjustable, exercise device as described in claim 1, with the device further comprising:

the base plate side edge surface having a plurality of protrusions comprising a plurality of strap mounts;

the adjustment slide lower slide mount portion rearward end having at least one forward and rearward locking pin hole there through, the adjustment slide upper working portion having a forward end and a rearward end, with a length there between, the rearward end of the adjustment slide upper working portion having the mounting bracket, the adjustment slide upper working portion having bolts for fixedly securing the adjustment slide upper working portion to the forward end of the adjustment slide lower slide mount portion;

the track slide being coupled to the adjustment slide lower slide mount portion, the forwardly mounted holding post of the track slide upper portion having a forwardly projecting pulley shoe, with a pulley bolt hole running trough the forwardly projecting pulley shoe, the upper portion of the track slide having an associated elastic band pulley, the associated elastic band pulley having a pulley bolt hole there through with an associated pulley bolt, the associated elastic band pulley being held in position with a pulley retention bracket; and the resistive means being an exercise elastic band comprising exercise elastic band ends, the exercise elastic band ends each having a stop ball and an attachment tab with an attachment aperture there through.

3. The chest mounted, adjustable, exercise device as described in claim 2, with the device further comprising:

the generally centrally located extending member mounting portion of the forward surface of the base plate being a generally semicircular forwardly projecting protrusion;

the adjustment slide lower slide mount portion forward end having at least one working end mounting bolt hole there through;

the upper portion of the track slide position retainer having a generally planar oval configuration with a retention band recess therein;

the forwardly mounted holding post of the track slide upper portion having a threaded aperture therein with an associated holding post retaining bolt, the track slide pulley retention bracket having a generally Z-shaped configuration;

the adjustment slide upper working portion mounting bracket having a pair of downwardly disposed tabs, with each tab having a plurality of bolt holes there through with associated adjustment slide upper working portion bolts; and the adjustment slide upper working portion mounting bracket having a pair of associated forward pulleys with associated forward pulley pins, the associated forward pulley pins respectively holding each of the associated forward pulleys within each respective U-shaped pulley receiving bracket.

4. The chest mounted, adjustable, exercise device as described in claim 3, with the device further comprising:

each base plate side edge surface strap mount having a strap slot there through;

the generally semicircular forwardly projecting protrusion of the base plate having an arcuate recess and a generally centrally located pivot pin hole;

the forward extension rail length having a first external width and a first external height;

the adjustment slide lower slide mount portion having a second internal width and a second internal height, the second internal width of the lower slide mount portion of the adjustment slide being greater than the first external width of the forward extension rail, the second internal height of the lower slide mount portion of the adjustment slide being greater than the first external height of the forward extension rail so as to allow the lower slide mount portion to be slideably mounted onto the forward extension rail, the adjustment slide upper working portion having an elastic band retainer for retaining the resistive means;

the forwardly mounted holding post of the track slide upper portion having an elastic guard, the track slide upper portion elastic guard having a generally curved planar configuration;

the pulley retention bracket having a rearwardly disposed lip which is sized to engage with and be received by the rearwardly located bracket mount slot of the upper portion of the track slide; and the adjustment slide upper working portion having a pair of stepped elastic band passageway grooves there in, the step of each elastic passageway groove having a first passageway internal diameter and a second passageway internal diameter, with the second passageway internal diameter being greater than the first passageway internal diameter, the stop balls of the respective exercise elastic band ends each having an external diameter which is smaller than the second passageway internal diameter of each stepped elastic band passageway groove and larger than the first passageway internal diameter of each stepped elastic band passageway groove, thereby allowing each stop ball to be nested within the respective stepped elastic band passageway grooves of the adjustment slide upper working portion.

5. The chest mounted, adjustable, exercise device as described in claim 4, with the device further comprising:

the rearward end of the rearward portion of the forward extension rail comprising a generally planar right surface having a curved terminus and a left surface with a curved side surface forming a side edge there between;

the lower portion of the track slide position retainer having an end flange;

the pulley retention bracket having a holding post bolt aperture there through for fixedly securing the pulley retention bracket to the forwardly mounted holding post of the upper portion of the track slide, the pulley retention bracket having a pulley bolt aperture there through with the associated pulley bolt for fixedly securing the associated elastic band pulley between the pulley retention bracket and the forwardly projecting pulley shoe; and the elastic band retainer having a generally H-shaped configuration.

6. The chest mounted, adjustable, exercise device as described in claim 5, with the device further comprising:

the base plate rearward surface having a generally raised area, the base plate arcuate recess having a plurality of position locking pin holes there through with an associated position locking pin, the generally centrally located pivot pin hole of the generally semicircular forwardly projecting protrusion of the base plate having an associated pivot pin and pivot pin nut;

the at least one forward and rearward locking pin hole of the adjustment slide lower slide mount portion rearward end having an associated forward and rearward locking pin;

the left surface of the rearward end of the rearward portion of the forward extension rail having a generally rightward offset;

the upper portion of the track slide position retainer having an uppermost surface, with the uppermost surface of the upper portion of the track slide position retainer having a cover threaded bolt hole there in, with the upper portion of the track slide position retainer having an associated cover bolt; and a track slide position retainer cover, having a generally oval side wall with an open end and a planar top portion, the planar top portion of the track slide position retainer cover having a cover retaining bolt hole there through thereby allowing bolting of the track slide position retainer cover to the track slide position retainer.

7. The chest mounted, adjustable, exercise device as described in claim 6, with the device further comprising:

the generally raised area of the base plate rearward surface being adjacent the side edge surface of the base plate;

the adjustment slide lower slide mount portion having an upper T-shaped track along the upper surface of the lower slide mount portion of the adjustment slide;

the left surface of the rearward end of the rearward portion of the forward extension rail being generally planar so as to be mated with and received by the generally semicircular forwardly projecting protrusion of the base plate;

the track slide having a lower generally T-shaped configuration being sized to be mated with and slidably received within the upper T-shaped track of the upper surface of the lower slide mount portion of the adjustment slide;

each attachment aperture of the respective exercise elastic band ends allowing a user to attach a hand grip to the exercise elastic band.

8. The chest mounted, adjustable, exercise device as described in claim 7, with the device further comprising:

the generally semicircular forwardly projecting protrusion of the base plate having a right side and a left side with a side edge there between, the right side forming a contacting surface, the contacting surface having a generally planar surface with the generally centrally located pivot pin hole there through;

the rearward end of the rearward portion of the forward extension rail having a pivot pin hole there through and a rearward end locking pin hole there through, wherein the rearward end locking pin hole is different from the plurality of forward and rearward locking pin holes.

9. The chest mounted, adjustable, exercise device as described in claim 8, with the device further comprising: the base plate, the forward extension rail, the track slide position retainer, and the track slide being fabricated of a rigid material; and the forward end of the forward portion of the forward extension rail having a generally rectilinear shaped terminus.

* * * * *